US009469495B2

(12) United States Patent
Caspar

(10) Patent No.: US 9,469,495 B2
(45) Date of Patent: Oct. 18, 2016

(54) APPARATUS AND METHOD FOR CUTTING A MATERIAL WEB

(71) Applicant: PAPRIMA INDUSTRIES INC., Dorval (CA)

(72) Inventor: Roman C. Caspar, Riehen (CH)

(73) Assignee: PAPRIMA INDUSTRIES INC., Dorval, QC (CA)

( * ) Notice: Subject to any disclaimer, the term of this patent is extended or adjusted under 35 U.S.C. 154(b) by 0 days.

(21) Appl. No.: 13/927,207

(22) Filed: Jun. 26, 2013

(65) Prior Publication Data

US 2014/0007749 A1 Jan. 9, 2014

Related U.S. Application Data

(63) Continuation of application No. PCT/CA2011/050811, filed on Dec. 28, 2011.

(30) Foreign Application Priority Data

Dec. 30, 2010 (DE) ..... 10 2010 056 576

(51) Int. Cl.
*B65H 20/14* (2006.01)
*B24C 1/04* (2006.01)
(Continued)

(52) U.S. Cl.
CPC ..... *B65H 20/14* (2013.01); *B24C 1/045* (2013.01); *B26D 7/1854* (2013.01); *B26D 7/20* (2013.01); *B26F 3/004* (2013.01); *B65H 19/265* (2013.01); *B65H 35/04* (2013.01); *D21F 7/006* (2013.01); *B26D 1/105* (2013.01); *B26D 7/01* (2013.01); *B26D 7/015* (2013.01); *B26D 7/18* (2013.01); *B65H 2406/11* (2013.01); *B65H 2801/84* (2013.01); *Y10T 83/2066* (2015.04)

(58) Field of Classification Search
CPC ..... B24C 1/045; B65H 35/04; B26D 7/1854
USPC ..... 83/13, 614, 100, 177, 649, 425.3, 499, 83/353, 53, 936–939, 402, 428, 98; 242/525.5, 525.6, 527.5, 527.6; 162/193, 194, 286, 310, 363, 364, 195, 162/198
See application file for complete search history.

(56) References Cited

U.S. PATENT DOCUMENTS 3,596,372 A 8/1971 Hundseid
3,848,327 A * 11/1974 Gerber et al. ..... 29/559
3,978,748 A * 9/1976 Leslie et al. ..... 83/53
4,496,515 A * 1/1985 Ptasienski et al. ..... 264/504
4,821,429 A 4/1989 Sieberth
(Continued)

FOREIGN PATENT DOCUMENTS

JP 06116892 A * 4/1994 ..... D21F 1/34

OTHER PUBLICATIONS

PCT/CA2011/050811 international search report with claims 1-12.

*Primary Examiner* — Ghassem Alie
(74) *Attorney, Agent, or Firm* — Anglehart et al.

(57) ABSTRACT

The invention relates to an apparatus and method for cutting a material web in a papermaking machine. The apparatus includes a cutting device, an upper holding device and an upper positioning device, the cutting device being fixed above the upper positioning device on the upper holding device such that it can be moved in the cross-machine direction. The apparatus additionally includes an air guide box that is fixed above the material web, likewise on the upper holding device.

12 Claims, 5 Drawing Sheets

Figure 1:
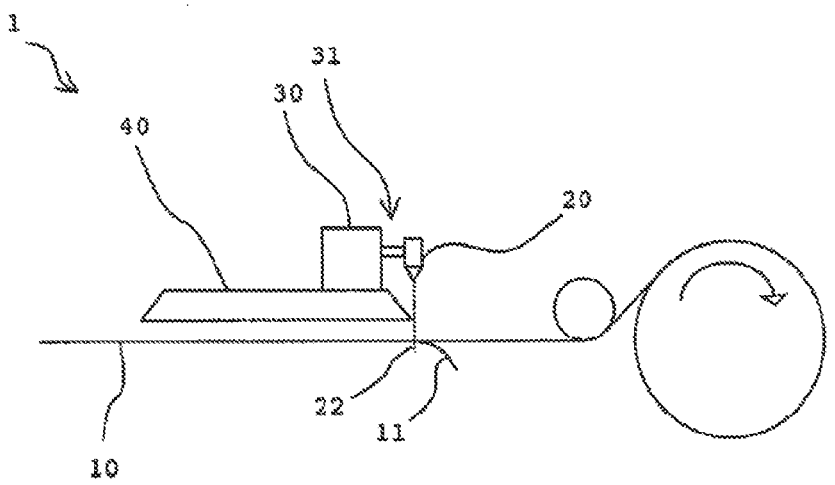

(51) Int. Cl.

| | |
|---|---|
| ***B65H 19/26*** | (2006.01) |
| ***B65H 35/04*** | (2006.01) |
| ***D21F 7/00*** | (2006.01) |
| ***B26D 7/20*** | (2006.01) |
| ***B26F 3/00*** | (2006.01) |
| *B26D 1/10* | (2006.01) |
| *B26D 7/01* | (2006.01) |
| *B26D 7/18* | (2006.01) |

(56) References Cited

U.S. PATENT DOCUMENTS

| | | | | |
|---|---|---|---|---|
| 5,068,513 | A * | 11/1991 | Gangemi | 219/121.67 |
| 5,379,526 | A | 1/1995 | Haverinen | |
| 5,711,088 | A | 1/1998 | Lindqvist et al. | |
| 6,001,219 | A * | 12/1999 | Caspar | 162/286 |
| 6,103,049 | A * | 8/2000 | Batdorf | 156/251 |
| 6,457,204 | B1 | 10/2002 | Baubock et al. | |
| 2002/0134523 | A1 | 9/2002 | Mantyla et al. | |

* cited by examiner

APPARATUS AND METHOD FOR CUTTING A MATERIAL WEB

The invention relates to an apparatus and a method for cutting a material web in a papermaking machine.

Papermaking machines—in particular those for hygienic paper—operate at the highest speeds available in the industry. Some machines run faster than 2,000 meters per minute and process paper products with a weight of only 9 to 27 grams per square meter and material web widths of about 5.8 m. At these high speeds, the paper material web or paper web (or else the strip of material) is very susceptible to web breaks and oscillates up and down like a sail on account of the air carried along with the material web. In such hygienic papermaking systems, it is necessary to sever the rough, unclean edges of the material web before the material web is wound up onto a spool. For this purpose, a high-pressure water jet is preferably used for the cutting.

One example of such a cutting apparatus is explained in U.S. Pat. No. 6,681,670 B2. This cutting apparatus has a cutting table equipped with an extraction device. The edge strip cut off is disposed of by the extraction device.

In order to prevent the increasing oscillations of the material web associated with the high speeds, papermakers have for some time used what are known as air guide boxes or blower boxes as a web stabilizer. Such an air guide box is described, for example, in DE 19 60 19 89 (also published as U.S. Pat. No. 5,893,505).

As a result of the increasingly higher operating speeds of papermaking systems, the severing of the edge strip becomes a more and more difficult task. In addition, the use of air guide boxes has a detrimental effect on the possibilities of severing edge strips, since fewer and fewer free web areas in which the severing could be carried out are available. In addition, after passing an air guide box, the material web bulges, which makes a cleaner cut more difficult. A further disadvantage is, additionally, that appliances for edge cutting and stabilization and further machine components in an increasingly restricted space hamper one another and therefore cannot be employed.

It is an object of the present invention to provide an apparatus and a method which improve the disadvantages of the prior art.

The object is achieved by the independent claims. Advantageous developments are defined in the sub-claims.

In particular, the object is achieved by an apparatus for cutting a material web (10) in a papermaking machine, comprising a cutting device (20), an upper holding device (30) and an upper positioning device (31), the cutting device (20) being fixed by means of the upper positioning device (31) on the upper holding device (30) such that it can be moved in the cross-machine direction, the apparatus additionally having an air guide box (40) and the air guide box (40) being fixed above the material web (10), likewise on the upper holding device (30).

The papermaking machine is a system in which a material web, in particular made of hygienic paper, can typically be transported in a transport direction and, at the end, can be wound up onto a spool (a roll).

The material web covers an ideal material web plane—disregarding process-induced oscillations, folds and distortions. The length or longitudinal direction is an extent substantially parallel to the material web plane and to the transport direction of the material web. The width or cross (machine) direction is an extent substantially parallel to the material web plane and perpendicular to the transport direction. The height or the vertical direction is an extent substantially perpendicular to the material web plane. In the following text, for the purpose of a simpler description of the subject matter of the invention, the basis used is a material web the plane of which lies perpendicular to the gravity vector, and the arrangement of the components is described relative to this material web plane. Another orientation of the material web plane is also possible, however. For instance, the material web plane can also lie parallel to the gravity vector or form an angle between 0° and 90° with the latter.

Above all during the production of hygienic paper, the material web has rough, unclean edges on the longitudinal sides. Therefore, the severing of these edges is necessary in order that the material web has clean edges at the end. For this purpose, at least the severing of one edge strip is provided, but preferably in each case one edge strip on each longitudinal side of the material web, i.e. the severing consists in a continuous longitudinal cut of the moving material web with the aid of at least one cutting device, so that, downstream of the cut, there is an edge strip substantially separated from the material web, which can then preferably be led away from the material web, and the material web is narrower by the width of the edge strip.

The cutting device is particularly preferably equipped with one or more features of the cutting apparatuses described in U.S. Pat. No. 6,681,670 B2. It is preferably aligned so as to sever an edge strip from the moving material web. Particularly preferably, the cutting device has at least one high-pressure jet nozzle, by means of which a high-pressure jet consisting of a cutting medium can preferably be generated.

The cutting medium is preferably a liquid, preferably water.

The apparatus for cutting the material web preferably has two cutting devices at the edges of the material web, particularly preferably a further cutting device which in the region of the center in the cross-machine direction of the material web.

The cutting device is preferably arranged on a vertical surface of the upper holding device.

The upper holding device is preferably arranged horizontally in the cross-machine direction above the material web. The holding device is preferably a supporting beam.

An air guide box is preferably a box-like component having a flat, preferably continuous, base surface as a stabilization surface with a width which is preferably greater than or equal to the width of the material web. The length depends on the application. The stabilization surface is preferably highly polished.

The air guide box is arranged with its stabilization surface close above the material web. Said stabilization surface is preferably parallel to the material web. The stabilization surface of the air guide box is then the underside of the air guide box in this case. The upper side of the air guide box is preferably connected firmly to the underside of the upper holding device (e.g. welded, screwed or adhesively bonded). The air guide box is preferably fixed to the holding device in such a way that it is at least partly located underneath the cutting device. As a result, the distance between the material web and the air guide box is smaller than that between the cutting device and the material web, which results in better stabilization. The air guide box is preferably connected to the holding device in the edge region of its upper side, close to its transverse edge preferably located downstream. In this way, the cutting medium from the cutting device can be guided past very close to the transverse edge of the air guide box from above the air guide box toward the material web underneath the air guide box. Alternatively, the air guide box is connected to the holding device approximately in the center of its longitudinal extent via its upper side. The cutting device then preferably has a relatively long mounting, so that the cutting device projects slightly over the transverse edge of the air guide box in the longitudinal direction. Particularly preferably, however, the air guide box has a cutout, as will also be described later, so that the cutting device, instead of projecting beyond the transverse edge of the air guide box, has an arrangement in which the cutting medium can be led through the cutout onto the material web.

As a result of arranging an air guide box with the stabilization surface close to the material web, stabilization of the material web is produced. The air carried along with the material web draws further ambient air with it, which means that suction between the stabilization surface and the material web is produced and the material web is thus stabilized.

The stabilization surface preferably has, upstream, an air outlet slot preferably stretched over the entire width of the surface and/or a row of small air outlet openings and/or air nozzles, which are aligned in such a way that they generate one or more air jets, which is/are aligned substantially parallel to the surface and in the running direction of the material web and has/have a substantially higher flow velocity than the running speed of the material web. The air outlet slot and/or a row of small air outlet openings and/or air nozzles is/are preferably countersunk into the surface. The air guide box is typically hollow on the inside, so that compressed air can be fed to a connection of the air guide box and can emerge through the air outlet slot and/or a row of small air outlet openings and/or air nozzles.

Through the air outlet openings on the stabilization surface of the guide box, compressed air is blown into the gap between the air guide box and the material web in the running direction of the material web. Such an air guide box is also designated a dynamic air guide box. The accelerated air produces suction, which attracts the material web by suction and stabilizes said web. As a result of the air jets from the air outlet openings, which jets are fast as compared with the surrounding air, the stabilizing effect of the air guide box is increased still further. In the running direction of the material web, a still higher negative pressure is produced between the material web and the lower surface of the air guide box. The negative pressure acts as suction on the material web, which is then drawn against the surface and is stabilized.

A positioning device is preferably one device or a combination of devices from the group: a rail system, preferably for translational movement, preferably with a carriage running on rails; a (linear) manipulator; a rope and pulley system; a gear wheel and/or rack system; a linear gear; a swiveling device having one or more swivel arms; one of the aforementioned devices driven by an actuating motor or stepping motor or pneumatic and/or hydraulic system.

Two rails, on which a carriage can be moved horizontally in the cross-machine direction, are preferably fitted to the holding device. This carriage can be moved to specific positions in the cross-machine direction by an actuating motor. The cutting device is mounted on the carriage.

In this way, the position at which the material web is cut can be defined in the cross direction. For instance, the width of an edge strip to be cut off can be determined in this way. In addition, the cutting device can be moved into specific parking positions; in which it does not hamper other machine components.

The fact that the air guide box and also the cutting device are fixed to the same holding device above the material web means that, for the first time, cutting the material web in the immediate vicinity of an air guide box is possible without individual components hampering one another. This provides the advantage that, despite an amount of space which is often inadequate, this cutting device can be installed in the papermaking machine. In order to carry out a cutting operation close to an air guide box, a large area of free web surface, which is increasingly seldom available because of the air guide boxes being inserted more and more densely into the transport path of the material web, is now no longer necessary.

In a further exemplary embodiment of the present invention, the air guide box (40) has a cutout (45), through which a cutting medium (22) can be led from the cutting device (20) to the material web (10).

A cutout is a region in the area covered by the length and width of the air guide box in which the air guide box is partly interrupted, i.e. has a hole. A cutout is preferably a drilled hole, preferably an elongated drilled hole. The cutout is preferably rectangular. It preferably interrupts a longitudinal side of the air guide box and/or is provided in the edge region of the latter. It preferably has two cutouts, which are in each case made in the region of the longitudinal sides, particularly preferably a third cutout in the region of the center of the width—in this way an edge cutter and/or a center cutter for the paper web can be implemented. Particularly preferably, there is a plurality of cutouts distributed in the cross-machine direction.

The cutout is preferably suitable for at least one cutting medium (e.g. high-pressure water jet or laser beam) to be led through, with which, in subsequent operation, the material web can be cut. Preferably, therefore, a straight rod of round cross section having a diameter of a high-pressure water jet or laser beam to be used later can be led through the cutout. The diameter of a high-pressure water jet or laser beam used for cutting the material web is preferably at least 0.1 mm.

The advantage of this cutout in the air guide box is that the cutting point for the cutting of the material web, for example of an edge strip, is now placed in a region of the material web in which the air guide box spans and thus stabilizes the material web. In the case of an air guide box, it is possible to observe that, in the normal case, the material web has a bulge directed upward after passing through the air guide box. Cutting in this region can lead to rough cut edges. By means of the cutout in the air guide box, however, the severing then takes place where the material web exhibits no oscillations or bulges since, apart from the region of the cutout, the material web is spanned in the cross direction by the air guide box and bulges are prevented as a result. A clean cut is therefore possible.

In a further exemplary embodiment of the present invention, the apparatus has

- a cutting table (23) and
- a lower holding device (50) underneath the material web (10) and
- a first lower positioning device (51) and/or a second lower positioning device (52), and the cutting table (23) is fixed to the lower holding device (50) via the first lower positioning device (51) and/or via the second lower positioning device (52), and it is possible for the cutting table (23) to be moved substantially vertically with respect to the material web (10) via the first lower positioning device (51) and/or to be moved in the cross-machine direction via the second lower positioning device (52).

Preferably, the cutting table is a surface facing the material web and made of material that is resistant to the cutting medium used. For instance, the cutting table is a stainless steel surface, preferably coated with tungsten carbide. Such a cutting table is listed, for example, in U.S. Pat. No. 6,681,670 B2. Thus, the cutting table preferably has an opening through which a cutting medium can be intercepted and/or led away. The preferred length of a cutting table according to the invention lies in the range from preferably 50 to 400 mm, particularly preferably 100 mm to 300 mm, the preferred width in a range between preferably 150 mm and 400 mm, particularly preferably 200 mm and 350 mm.

The cutting table additionally preferably has an inclined surface on its front (upstream) broad side. This is preferably made of stainless steel and preferably has the same dimension transversely as the cutting table. The inclined surface preferably forms with the vector of the running direction of the material web an angle of less than 90 degrees, preferably less than 60 degrees, particularly preferably less than 30 degrees. The edge of the inclined surface facing the material web preferably has the same spacing from the material web as the surface of the cutting table facing the material web. The inclined surface is preferably fitted directly to the cutting table. The inclined surface preferably ends flush with the cutting table surface or the surface of the cutting table that faces the material web. The inclined surface is particularly preferably at least partly curved. Particularly preferably, the front broad side of the cutting table is already configured as a corresponding inclined surface.

Preferably, at least one cutting table has a chute for leading away the edge strip cut off. The chute is preferably set up in such a way that the severed edge strip slides automatically into the chute, preferably as a result of the movement of the material web. The chute preferably has a curvature which represents a transition from the material web plane into the chute, which is preferably oriented substantially at right angles with respect to the material web plane. The chute is preferably connected to a device for producing a negative pressure within the chute.

The lower holding device is preferably a supporting beam, which is arranged transversely underneath the material web; particularly preferably the area of floor underneath the material web.

The first lower positioning device is equipped to move the cutting table in the vertical direction (i.e. upward and downward). In this way, the cutting table can be moved up from a remote position underneath the material web close to the material web. In a position close to the material web, the cutting table supports the material web.

The second lower positioning device is equipped to move the cutting table in the cross-machine direction to predefined positions. For instance, the second lower positioning device is a rail let into the floor underneath the material web, on which rail a carriage can be moved in the cross-machine direction by an actuating motor. The cutting table is then fitted to this carriage, either directly or via the first lower positioning device. Particularly preferably, the second lower positioning device is fixed to the lower holding device. By means of the second lower positioning device, the cutting table can be moved in the cross-machine direction to the position which is located directly underneath the cutting point of the cutting device.

A transverse movement of the cutting device can in this way likewise be carried out by means of a transverse movement of the cutting table with the aid of the second lower positioning device. Thus, the cutting table is able to track the transverse movements of the cutting device.

Each of these lower positioning devices, on its own or in combination with the other, permits the cutting table to be moved into a parking position.

For instance, when only the first lower positioning device is present, the cutting table can be moved into a parking position which is located at a distance underneath the material web. The cutting table is then preferably designed to be so wide that the cutting device, above the material web, has a movement travel in the cross-machine direction which is smaller than or equal to the width of the cutting table. Preferably, the discharge channel for edge strips cut off is then approximately extended over the entire width of the cutting table. In this way, the cutting table can be moved vertically into a parking position and, in the operating position, the cutting device can be moved in the cross-machine direction, the width of the cutting table permitting it to support the material web in every position of the cutting device and, preferably, in every possible cutting position, the cutting table being located underneath the cutting point in the cross-machine direction.

If only the second lower positioning device is present, the cutting table can preferably be moved into a parking position at the side of the material web. This solution is preferred when there is also sufficient space at the side of the material web for a parking position of the cutting table. The cutting table preferably has a lower width, since the cutting table is able to track the movements of the cutting device in the transverse direction. This provides the advantage that the width of the discharge channel is also narrower. As a result, destabilizing web tensions which can be produced by an excessively wide discharge channel are prevented, since the discharge channel represents an aerodynamic discontinuity of the cutting table and an extraction device often also draws with it air from the direction of the material web into the extraction channel, in order that a paper strip is led away better there.

In many cases, however, there is not sufficient space at the side of papermaking machine, so that a combination of the first and second lower positioning devices is particularly advantageously provided. In this way, it is possible to use a cutting table with a low width since, on account of the second lower positioning device, said cutting table is able to track the movements of the cutting device and the cutting table can be moved into a parking position which is located at a distance underneath the material web.

Preferably, on its own the cutting table fixed such that it can be moved vertically and/or in the cross-machine direction on the lower holding device via the first lower and/or second lower positioning device represents an independent solution to the technical problem, independently of the upper holding device, the air guide box and the cutting device. The cutting table can be moved independently of the cutting device but, at the same time, is also able to match the movements of the cutting device. The cutting table can be moved into a parking position separately from the cutting device. This is particularly helpful in order to avoid specific other machine components, which would not be possible if the cutting table were to be connected fixedly to the cutting device. Thus, for example, it is possible to move out of the way of the C-shaped threading channel, which is used to thread a paper web into the papermaking machine. These channels are normally located at the edge of the web underneath an air guide box. On its own, this cutting table therefore already considerably improves the ability to install a cutting apparatus in a papermaking machine.

In a further exemplary embodiment of the present invention, the apparatus additionally has synchronizing means (60) for the synchronization of movements of the cutting device (20) and of the cutting table (23) in the cross-machine direction.

The synchronizing means or synchronizing device is preferably a computing unit, which drives the upper and/or the second lower positioning device and thus equalizes the positions of the cutting device and cutting table with one another in the cross-machine direction. The positioning devices are preferably equipped to feed back position signals. The synchronizing device is preferably equipped to analyze this position information and, by activating one or both positioning devices, to keep the positions of cutting table and cutting device continuously at one level with respect to the cross-machine direction. A synchronizing device is in particular a mechanical transmission system, comprising inter alia a shaft which is preferably provided with one or more universal joints and connects the upper and the second lower positioning device synchronously to each other.

Synchronization of movements of the cutting device and of the cutting table is preferably the continuous matching of the position of the cutting table and/or of the cutting device at the same level with respect to the cross-machine direction.

In this way, even in the case of cuts which are carried out while the cutting device is moving, the material web can be stabilized optimally by the cutting table, since the latter is always positioned in the area of the cutting point underneath the material web.

In a further exemplary embodiment of the present invention, the cutting device (20) additionally has at least one knock-off medium nozzle (26), which is arranged downstream after the cutting device (20).

A knock-off medium nozzle preferably produces a conical air jet, preferably a triangular two-dimensional jet. It is preferably equipped to produce a jet of a knock-off medium. A knock-off medium is preferably air, particularly preferably another gas. The knock-off medium nozzle is preferably arranged such that it can be moved in the cross-machine direction together with the cutting device via the upper positioning device on the upper holding device. The arrangement downstream after the cutting device preferably means that the material web first passes the cutting device and then the knock-off medium nozzle.

Preferably, two or more knock-off medium nozzles are provided. These are preferably arranged in a row in the transverse direction. The number of knock-off medium nozzles is determined by the width of the edge strip to be separated off. The apparatus preferably has a multiplicity of knock-off medium nozzles arranged in a row. The fact that these can be moved in the cross-machine direction together with the cutting device means that the width of the edge strip to be removed can be adjusted very flexibly. The maximum width of the edge strip to be removed is then determined, for example, via the width of the row comprising the knock-off medium nozzles, preferably additionally by the opening angle of the individual nozzles.

The knock-off media that are present are preferably arranged in the cutting table vertically above the discharge channel for the edge strip. In this way, the knock-off medium jet forces the edge strip preferably directly into the discharge channel.

In a further exemplary embodiment of the present invention, the upper holding device (30) above the material web (10) and/or, if present, the lower holding device (50) underneath the material web (10) is/are fixed in the cross-machine direction with both ends on vertical pillars (70) beside the papermaking machine.

Preferably, in each case a vertical pillar stands on the right and left beside the material web. Both the upper holding device and the lower holding device are in each case fixed to one of these vertical pillars by one end. In this way, the vertical pillar, which is normally present in a machine, is advantageously used to position the cutting device and/or the cutting table. As opposed to the case in which the cutting device and/or the cutting table is/are fixed to suspension systems newly introduced into the papermaking machine specifically for these devices, a vertical pillar which, for example, has already been erected for an air guide box, then no longer represents any obstacle to the travel movement of a cutting device and/or the cutting table.

The object is also achieved by a method for cutting a material web (10) in a papermaking machine, comprising the steps moving a cutting device (20) in the cross-machine direction, the cutting device (20) being fixed to an upper holding device (30) such that it can be moved in the cross-machine direction;

cutting the material web (10) with the aid of a cutting medium (22) from the cutting device (20);

characterized in that in addition, the following step is carried out stabilizing the material web (10) during the cutting by means of an air guide box (40) above the material web (10), the air guide box (40) likewise being fixed to the upper holding device (30).

The cutting of the material web is preferably the severing of at least one edge strip from the material web and/or the dividing of the material web into at least two parts by means of a cut, for example in the center of the material web. The cutting is preferably carried out with the aid of a high-pressure jet, consisting of a cutting medium. This high-pressure jet is blasted out of the cutting device onto the material web.

The movement of the cutting device is preferably carried out during the cutting, preferably by using an upper positioning device. Particularly preferably, the cutting device is firstly moved to a point at which the cut is intended to be carried out and the cutting device is then activated. As a result of the movement, the width of an edge strip to be cut off is preferably defined and/or the shape of the cut through the material web is configured by movement being carried out during the cutting.

The stabilization of the material web is preferably carried out by actively blowing compressed air through between the material web and the stabilization surface of the air guide box. Particular preference is given to the stabilization of the material web of a passive air guide box at a short distance from the material web. A passive air guide box is a stabilizer that does not use compressed air or a vacuum source, and air guide box, as used herein, is intended to mean both stabilizer devices using compressed air or vacuum, as well as passive air foils.

The cutting medium is additionally preferably led to the material web through a cutout in the air guide box. In this way, the material web is stabilized still better and bulging, which can occur in the material web after passing the stabilization surface of the air guide box, is prevented. The cutting is therefore carried out in a very well stabilized area of the material web.

In addition, the step comprising fixing the air guide box above the material web and fixing the cutting device to the upper holding device is preferably carried out.

A further method according to the invention further comprises the step moving a cutting table (23) substantially in the vertical direction with respect to the material web (10) and/or in the cross-machine direction, the cutting table (23) being fixed to a lower holding device (50) underneath the material web (10) such that it can be moved.

By means of the vertical movement of the cutting table, the cutting table is preferably moved so close to the material web that the cutting table just does not touch the latter, at least when cutting is currently not being carried out. The material web is preferably supported by the cutting table during the cutting. As a result of moving the cutting table in the transverse direction, the cutting table is preferably positioned underneath the cutting device in such a way that the cutting table is located underneath the cutting device with respect to the cross-machine direction. The cutting table is preferably moved in such a way that the cutting medium jet is intercepted by the opening in the cutting table for intercepting and carrying away the cutting medium.

Preferably, at least one parking position of the cutting table is moved to by moving the cutting table in the vertical direction and/or horizontal direction.

A further method according to the invention additionally comprises the step synchronizing the movement of the cutting table (23) in the cross-machine direction and the movement of the cutting device (20).

Cutting table and cutting device are preferably kept continuously at the same level with respect to the cross-machine direction.

A further method according to the invention additionally comprises the steps aligning and activating the cutting device (20) so that a longitudinal cut edge (12) is produced from the start within an edge (14) of the material web (10);

aligning and activating a knock-off medium nozzle (26), which is arranged downstream of the cutting device (20), so that an area of the material web (10) between the longitudinal cut edge (12) and the edge (14) of the material web (10) that is close to the longitudinal cut edge (12) tears off transversely and this area forms the start of the edge strip (11).

The alignment of the cutting device is preferably carried out by moving the cutting device in the cross-machine direction into a position such that the cutting device is within the edges of the material web, above the material web. As a result of activating the cutting device in this position, a direct incision into the material web is produced. As compared with the start of a cut in which the cutting device is first activated and the cutting device is then moved into the material web from outside the material web, such an incision has the advantage that the cutting medium does not move through the often highly damaged and unsteadily fluttering outer edge of the material web thus leading to web breaks. Further within the material web edge, the material is stronger and, by means of a direct incision which only begins within the edge of the material web, together with the knocking off, the edge strip is torn in a controlled manner.

The knock-off medium nozzle is preferably aligned in such a way that a two-dimensional jet strikes the material web between cut edge and the material web edge. This two-dimensional jet is preferably produced by a nozzle having a slot-like outlet opening and/or a nozzle for producing a triangular jet or conical jet. Particularly preferably, a row of at least two, preferably three or more, knock-off medium nozzles is aligned and activated, the sum of the individual jets of the knock-off medium nozzles having the effect of an elongated jet in the transverse direction.

Figure 2:
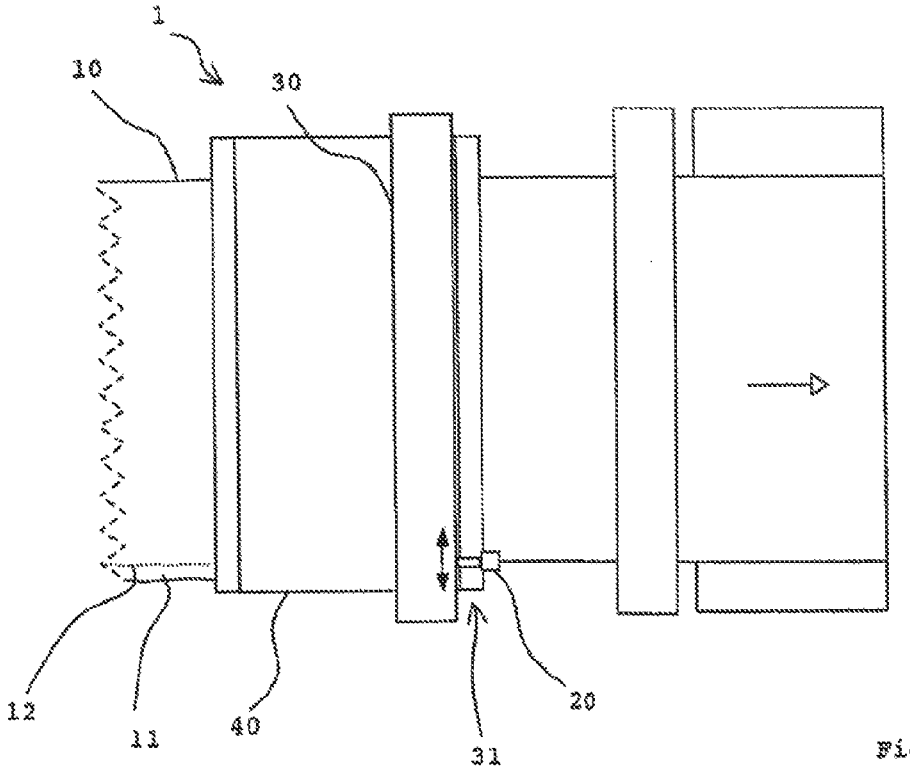
Figure 3:
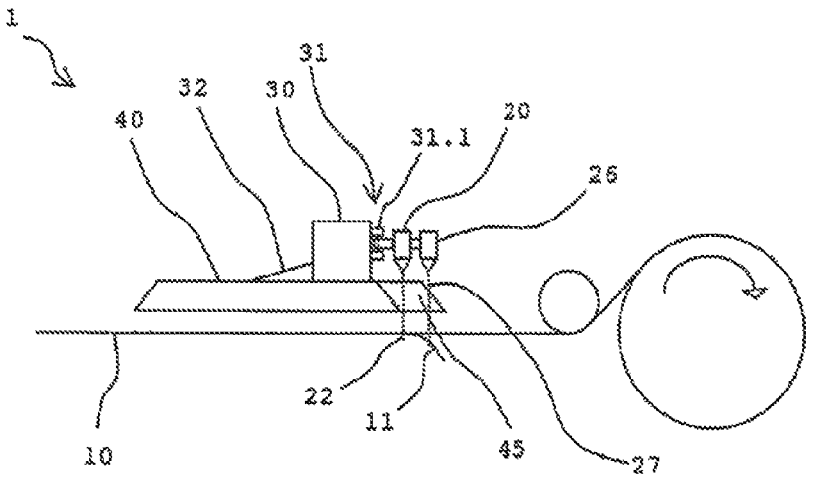
Figure 4:
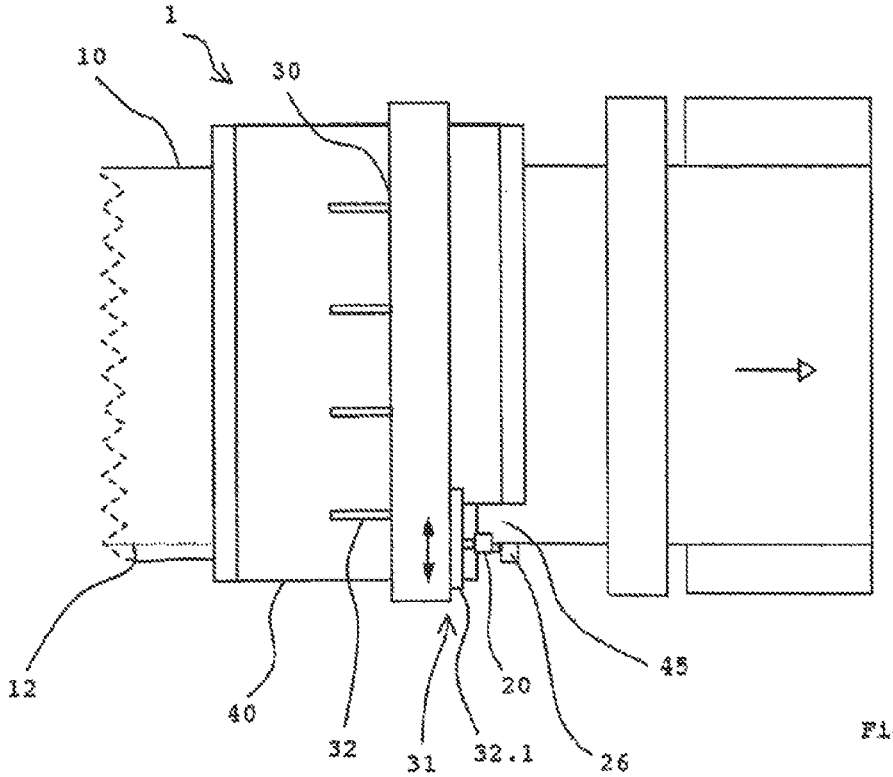
Figure 5:
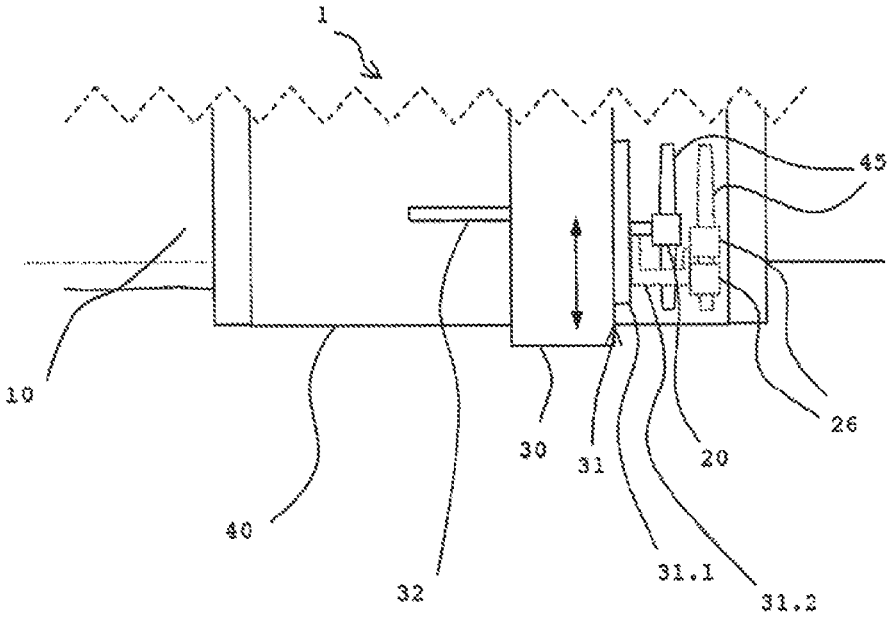
Figure 6:
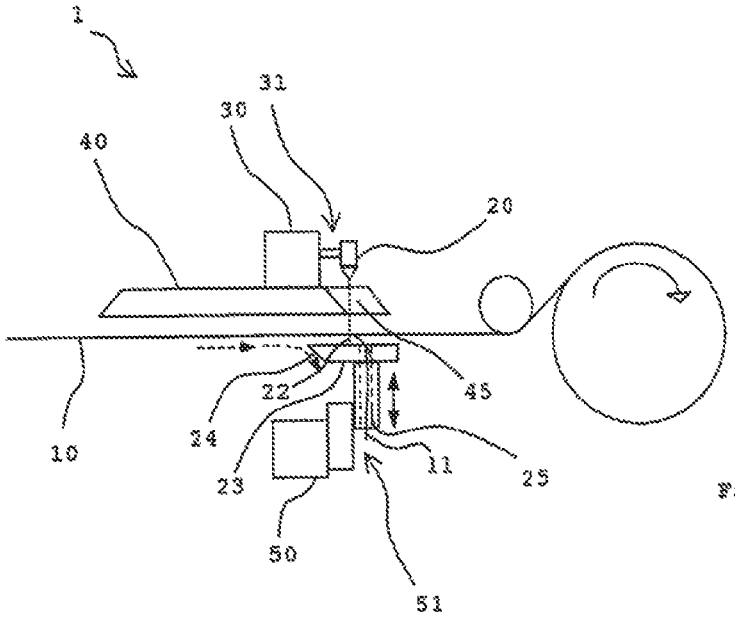
Figure 7:
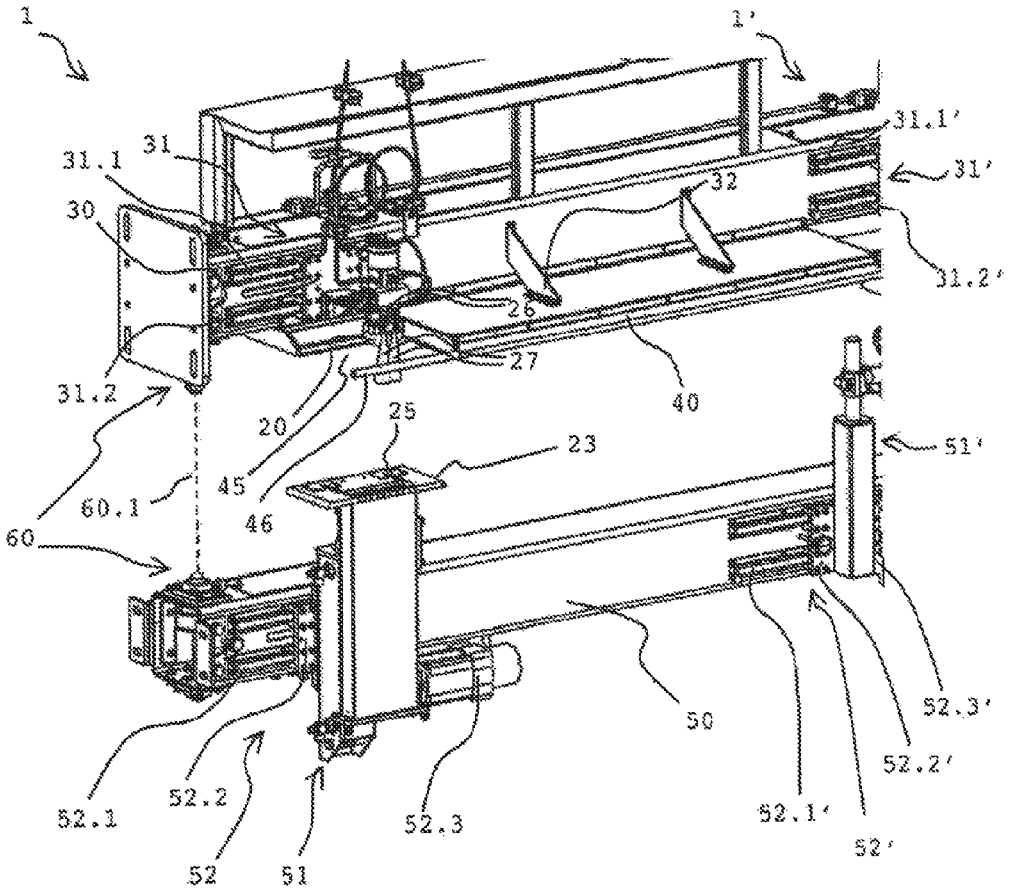
Figure 8:
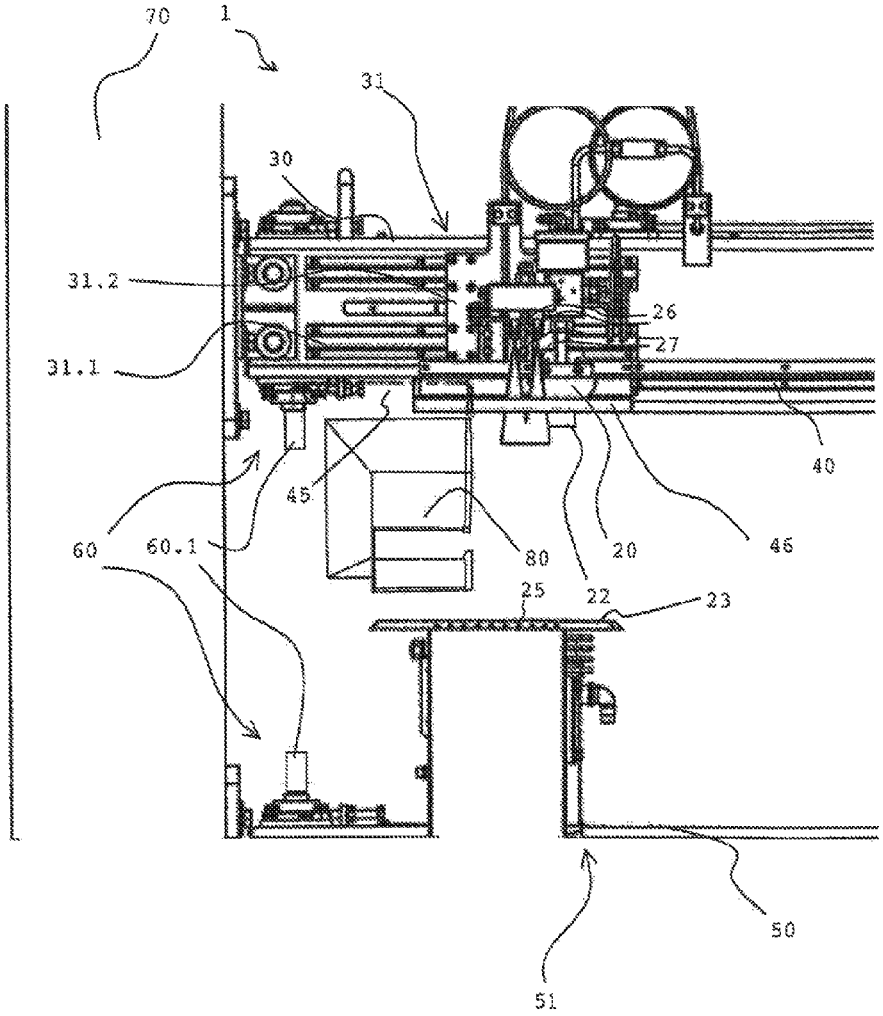

The invention is now to be illustrated further by way of example by using drawings, in which:

FIG. 1 shows a side view of an apparatus according to the invention having a cutting device and an air guide box which are both fixed to an upper holding device above a paper web, FIG. 2 shows a plan view of the apparatus according to FIG. 1, FIG. 3 shows a side view of an apparatus according to the invention, the apparatus additionally having another upper positioning device, a knock-off medium nozzle and a cutout in the air guide box, FIG. 4 shows a plan view of the apparatus according to FIG. 3, FIG. 5 shows a plan view of a similar apparatus according to FIG. 4, the cutout being an elongated hole, FIG. 6 shows a side view of an apparatus according to the invention additionally comprising a cutting table that can be moved vertically, FIG. 7 shows a perspective illustration of an apparatus according to the invention, additionally comprising synchronizing means, FIG. 8 shows a perspective view of an apparatus according to the invention together with a machine component of the papermaking installation which no longer collides with the apparatus according to the invention.

FIG. 1 shows a side view of an apparatus 1 according to the invention having a cutting device 20 and an air guide box 40, which are both fixed 10 to an upper holding device 30 above a paper web. The air guide box 40 is welded to the underside of the holding device 30 via a region on the upper side of said air guide box, close to the transverse edge of the air guide box 40. The holding device 30 is a supporting beam which is stretched transversely over the material web. Via an upper positioning device 31, the cutting device 20 is arranged on the vertical transverse side of the supporting beam 30 such that it can be moved. The positioning device 31 has a holder, which reaches into the interior of the supporting beam 30 and can be moved there. The cutting device 20 is screwed firmly to the holder. The material web 10 runs just underneath the stabilization surface of the air guide box 40. Placed downstream is a spool, onto which the material web 10 can be wound after the apparatus 1. Air guide box 40, holding device 30 and the cutting device 20 fixed to the holding device 30 such that it can be moved by the positioning device 31 form a structural unit that can be installed.

During operation of the apparatus 1, the material web 10 is wound onto the spool. It runs through the area of the papermaking machine spanned by the air guide box 40 and is stabilized by the air guide box 40. The cutting device 20 has been fixed directly to the holding device 30 via an upper positioning device 31 and the air guide box 40. The cutting device 20 produces a high-pressure jet of a cutting medium 22 and just after the end of the air guide box 40, blasts the jet onto the material web 10. There, the cutting medium 22, together with the movement of the material web 10, effects a longitudinal cut edge (not shown here) starting from the cutting point 21. Here, the severing of an edge strip 11 is carried out. This apparatus 1 permits clean cut edges or cuts through cutting the material web 10, despite restricted space. This becomes possible as a result of the combining of the air guide box 40 and a cutting device 20 to form one component having a common holding apparatus 30. Thus, a cut can be carried out close to an air guide box 40 in a space restricted by the air guide box 40.

FIG. 2 shows a plan view of the apparatus 1 according to FIG. 1. In this example, the cutting device 20 can be moved in the cross-machine direction (indicated here by a double arrow) over the entire width of the material web 10 along the supporting beam 30. On the material web 10, which runs in upstream of the air guide box 40, a dotted line indicates the future longitudinal cut edge 12 and the edge strip 11 produced in the future at the web edge 14.

FIG. 3 shows a side view of an apparatus 1 according to the invention, the apparatus additionally having another upper positioning device 31, a knock-off medium nozzle 26 and a cutout 45 in the air guide box 40. In addition, triangular ribs are shown as fixing means 32. The air guide box 40 is screwed to the holding device 30 via the fixing ribs 32 and also directly. The positioning device 31 has, on the vertical side of the holding device 30, an upper and a lower rail 31.1, in which a holder for a cutting device 20 is held such that it can be moved in the transverse direction. A knock-off medium nozzle 26 is additionally mounted on the cutting device 20 via a further holder.

During operation of the apparatus 1, the cutting device 20 blasts a cutting medium 22 through the cutout 45 onto the material web 10. The knock-off medium nozzle 26 is activated and a knock-off medium jet 27 tears the start of the edge strip 11 abruptly off the material web 10.

As a result of the fixing ribs 32, the fixing of the air guide box 40 is still more stable. Since the cutting device 20 is if possible arranged at a transverse end of the air guide box 40, the air guide box 40 is not fixed to the holding device 30 at its center. By means of the fixing ribs 32, therefore, the relatively large area of the air guide box 40 which is further removed from the holding device 30 is better stabilized. By means of the knock-off medium nozzle 26, it is possible to arrange for the cut into the material web 10 by the cutting medium 22 to begin only within the web edge 14. As a result of the knocking off, an additional transverse cut edge or transverse tearing edge is produced, which extends from the web edge 14 as far as the longitudinal cut edge 12.

FIG. 4 shows a plan view of the apparatus 1 according to FIG. 4. This illustration makes it clear that the cutout 45 in this case represents a rectangular cutout 45 in the downstream corner region of the air guide box 40. The knock-off medium nozzle 26 is fixed to the cleaning device 20 via a holder, slightly offset with respect to the cleaning device 20, and can be moved together with the latter in the transverse direction. The apparatus additionally has a plurality of fixing ribs 32, which are distributed uniformly along the supporting beam 30.

During operation of the apparatus 1, the cutting device 20 is moved in the transverse direction together with the knock-off medium nozzle 26 in the region of the cutout 45. From the parking position, which is wholly outside on the supporting beam 30, the cutting device is moved to the position which, in the cross-machine direction, is located at the level of the future longitudinal cut edge 12. After reaching this position, the cutting device 20 is activated so that the latter blasts a cutting medium 22 onto the material web 10. The point of the first incision into the material web 10 then moves in the transport direction (indicated by the contour arrow) toward the knock-off medium nozzle 26. The latter is then activated as soon as the first incision point passes/has passed the point of impingement of the knock-off medium 27 and a transverse tearing edge is produced by the knock-off medium 27. The air guide box 40 stabilizes the material web 10 during this, and bulges which could result in the transverse direction after running through the air guide box 40 are also not in the area of the cutting device 20, since the latter is located upstream of the transverse edge of the air guide box 40 on account of the cutout 45. The area of the cutout 45, as compared with the stabilization surface of the air guide box 40 in the transverse direction, is so small that bulging of the material web 10 in the area of the cutout 45 does not take place or is not very pronounced.

FIG. 5 shows a plan view of a similar apparatus 1 according to FIG. 4, the cutout being an elongated hole. In addition, two optional (shown dashed) knock-off medium nozzles 26 can be moved together in the cross-machine direction via a carriage 31.2, together with the cutting device 20, by the positioning device 31. Furthermore, there is a second optional cutout 45, which is likewise an elongated hole, it being possible for the knock-off medium 27 to be led through this second cutout 45.

During operation of the apparatus 1, the cutting medium 22 blasts through the elongated cutout 45. If, in addition, there are knock-off medium nozzles 26, these blast the knock-off medium through the second elongated hole 45 that is present, in order to knock the edge strip 11 off the material web 10.

In this way, the material web 10 is stabilized even better, since the air guide box 40 is pierced by cutouts 45 in still smaller areas.

FIG. 6 shows a side view of an apparatus 1 according to the invention additionally comprising a cutting table 23 that can be moved vertically. The cutting table 23 has a surface which can be brought up close to the material web 10. In addition, it has an inclined surface 24 and a discharge channel 25 for the edge strip 11 (indicated dashed). Via a first lower positioning device 51, it can be moved vertically up to the material web 10. The positioning device 51 connects the cutting table 23 to a lower holding apparatus 50. The lower holding device 50 is a supporting beam, which is arranged transversely underneath the material web 10.

During operation of the apparatus 1, the cutting table 23 is brought up from below from a position far below the material web 10 until it is close to the material web 10. During the cutting, the surface of the cutting table 23 supports the material web 10. Air carried along with the material web (dashed arrows) is deflected away from the material web 10 by the inclined surface 24. The edge strip 11 is intercepted and led away via the channel 25 integrated into the cutting table 23. After the cutting operation, the cutting table 23 is moved into a parking position once more, so that the latter does not represent any obstacle to other operations or machine components.

In this way, the cutting table 23 can thus be cleared very flexibly out of the way again when it is not needed. The inclined surface 24 improves the stabilization of the material web 10 by the cutting table 23.

FIG. 7 shows a perspective illustration of an apparatus 1 according to the invention, additionally comprising synchronizing means 60. In this example, the synchronizing means 60 comprise, inter alia, a shaft 60.1 (indicated by a dashed line), which is mounted in both holding devices 30 and 50 such that it can be rotated. In case the holding devices 30 and 50 are displaced with respect to each other, the shaft 60.1 has at least one universal joint in between. Within the holding devices 30 and 50 there are arranged, for example, universal joints, gear mechanisms, or a deflection roller of a rope and pulley system firmly connected to the shaft 60.1 in rotation, none of which is visible, and which transmit the movement of the shaft 60.1 in each case to the positioning devices 31 and 52. The cutting table 23 is arranged on the lower holding device 50 such that it can be moved in the transverse direction via the second lower positioning device 52. The lower second positioning device 52 has a rail/carriage system (52.1, 52.2) and can be actuated via an actuating motor 52.3. The actuating motor 52.3 displaces the carriage 52.2 in the transverse direction on the rails 52.1. In this example, the cutout 45 is a rectangular cutout 45 in the corner region of the air guide box 40. In addition, by means of a round metal 46, the transverse edge of the air guide box 40 in the region of the cutout 45 is lengthened. At the right-hand edge of the graphic, a further apparatus 1' according to the invention is fitted to the upper transverse beam 30 via a further upper positioning device 31', as illustrated as a detail. This is set up for a central cut of the material web 10. Also arranged underneath is a further cutting table (not to be seen), which has no chute 25 however, since no edge strip 11 has to be led away there. It can be moved vertically and in the transverse direction via the lower positioning devices 51' and 52'.

During operation of the apparatus 1, the knock-off medium nozzles 26 produce conical jets of the knock-off medium 27 at the start of the cutting process. The edge strip 11 then falls into the chute 25. However, in this image, the cutting table 23 is in the parking position. The actuating motor 52.3 is activated, by which means the cutting table 23 is moved along the lower holding device 50. Via the shaft 60.1, the rotational movement of the actuating motor 52.3 is transmitted to the upper positioning device 31, which means that the carriage 31.2 and therefore also the cutting device 20 are moved synchronously with the cutting table 23.

By means of the synchronizing means 60, the position of the cutting table 23 in the transverse direction is kept in the same position as the cutting device 20. As a result, optimal assistance of the cutting operation by the cutting table 23 is possible. As a result of lengthening the transverse edge of the air guide box 40 via the round metal 46, bulging of the material web 10 after passing through the air guide box 40 is suppressed still further in the area of the cutout 45. By means of the conical jets of the knock-off medium 27, an edge strip 11 can be knocked effectively off the material web.

FIG. 8 shows a perspective illustration of an apparatus 1 according to the invention together with a machine component 80 of the papermaking machine, which then no longer collides with the apparatus 1 according to the invention. In addition, a vertical pillar 70 is shown, to which both the upper holding device 30 and the lower holding device 50 are screwed. The machine component 80 in this case is a C-shaped or U-shaped channel for threading in the material web 10.

During operation of the apparatus 1, the cutting table is moved from the parking position (as shown) around the machine component 80 via a vertical and horizontal movement into the operating position directly underneath the air guide box 40.

In this graphic, advantages of this invention become clear. The fact that the cutting device 20 and the air guide box 40 are fitted to the same holding device 30 means that, in this restricted space in the direct vicinity of the air guide box 40, a cut in the material web 10 can be made by the cutting device 20. In addition, as a result of the mobility of the cutting table 23 and on account of the arrangement of the cutting table 23 separately from the cutting device 20, on the lower holding device 50, high flexibility of the cutting table 23 is made possible. The latter can therefore be moved around machine components 80 from a parking position into an operating position. Therefore, considerable flexibility is achieved despite the restricted space. The vertical pillar 70 in this example would, for example, stop it being possible to move to a parking position at the side of the papermaking machine. By using the apparatus 1 according to the invention, firstly the cutting device 20 can be moved into a suitable parking position and, secondly, the cutting table 23 can be moved into another suitable parking position.

By means of this invention, for the first time an apparatus for cutting a material web has been proposed which can be incorporated in an existing papermaking installation without any obstruction of other machine components by this apparatus, or vice versa, taking place. It is distinguished, inter alia, by the combination of an air guide box and a cutting device, which is additionally space-saving. The joint fitting of these components to an upper holding device permits mounting in the most restricted space in the papermaking machine and, at the same time, the apparatus has the advantage that, on account of the compact combination of cutting device and air guide box, the cutting of the material web is now carried out in an area of the material web close to the air guide box, which stabilizes the material web. A cutout in the air guide box permits further displacement of the cutting point into an area of the material web which is even better stabilized, which means that extremely exact cuts are possible. The flexibility and intelligent use of restricted space in the papermaking machine is additionally or alternatively improved further by a cutting table arranged separately from the cutting device. In this way, the cutting table, which can be moved vertically and/or in the cross-machine direction, can be moved around other machine components. Nevertheless, by means of the cutting table, which can be brought up from below close to the material web and the cutting point, optimal supporting and stabilizing of the material web is carried out. In addition, respectively different parking positions can be defined for the cutting device and the cutting table. Via positioning devices, both the cutting device and the cutting table can be moved flexibly for different cutting contours and cutting types. As a result of synchronizing the movements in the cross-machine direction, perfect coordination of the cutting table and the cutting device with each other is possible, which means that the table supports the cutting operation optimally in any position with respect to the cross-machine direction. The mobility of the cutting table in the vertical direction additionally permits the stabilizing action of the cutting table to be adapted individually via the distance of the cutting table from the material web.

| | |
|---|---|
| 1 | Apparatus for cutting a material web |
| 10 | Material web |
| 11 | Edge strip |
| 12 | Longitudinal cut edge |
| 14 | Web edge |
| 20 | Cutting device |
| 21 | Cutting point |
| 22 | Cutting medium, high-pressure water jet or laser beam |
| 23 | Cutting table |
| 24 | Inclined surface |
| 25 | Chute/discharge channel |
| 26 | Knock-off medium nozzle |
| 27 | Knock-off medium |
| 30 | Upper holding device |
| 31 | Upper positioning device |
| 31.1 | Rail |
| 31.2 | Carriage |
| 32 | Fixing means |
| 40 | Air guide box |
| 45 | Cutout |
| 46 | Round metal |

-continued

| | |
|---|---|
| 50 | Lower holding device |
| 51 | First lower positioning device |
| 52 | Second lower positioning device |
| 52.1 | Rail |
| 52.2 | Carriage |
| 52.3 | Actuating motor |
| 60 | Synchronizing means |
| 60.1 | Shaft |
| 70 | Vertical pillar |
| 80 | Machine component |

The invention claimed is:

1. A method for making paper in a paper making machine in which a paper material web can be transported with high speed in a transport direction, said method comprising cutting the paper material web moving with high speed through the papermaking machine, said cutting comprising:

moving a cutting device in a cross-machine direction above the paper material web, the cutting device being movably mounted to an upper holding device arranged above the paper material web, the cutting device being movable along the upper holding device over at least a portion of a width of the paper material web;

generating with the cutting device a cutting medium that, when applied to the paper material web moving with high speed, cuts the paper material web;

stabilizing and preventing speed-induced oscillations in the paper material web during said cutting as the paper material web moves with high speed through the papermaking machine by means of an air guide box fixedly connected to an underside of the upper holding device, the air guide box being positioned above the paper material web, the air guide box having a substantially enclosed, box-like body including an upper surface and a bottom surface, the bottom surface being a flat and substantially continuous surface spanning at least a majority of a width of the paper material web and defining a stabilization surface extending substantially parallel to the paper material web; and positioning the cutting device along the upper holding device such that, during said cutting, the air guide box is located at least partly underneath the cutting device and said cutting of the moving paper material web by the cutting medium occurs proximate to the stabilization surface of the air guide box.

2. A method according to claim 1, further comprising moving a cutting table substantially in the vertical direction with respect to the paper material web and/or in the cross-machine direction, the cutting table being fixed to a lower holding device underneath the paper material web such that the cutting table can be moved via the lower holding device.

3. A method according to claim 2, further comprising synchronizing the movement of the cutting table in the cross-machine direction and the movement of the cutting device.

4. A method according to claim 1, further comprising aligning and activating the cutting device such that a longitudinal cut edge is produced proximate to an edge of the paper material web;

aligning and activating a knock-off medium nozzle arranged downstream from the cutting device, such that an area of the paper material web between the longitudinal cut edge and the edge of the paper material web that is close to the longitudinal cut edge tears off transversely and this area forms the start of an edge strip.

5. A method according to claim 1, further characterized in that during said cutting, a distance between the paper material web and said air guide box is smaller than that between the cutting device and the paper material web.

6. A papermaking machine in which a paper material web can be transported with high speed in a transport direction, said papermaking machine comprising:

an apparatus for cutting the paper material web moving with high speed through the papermaking machine, said apparatus including:

a) a holding device arranged in a cross-machine direction above the material web;

b) a positioning device movably mounted to said holding device, said positioning device movable along said holding device in the cross-machine direction over at least a portion of a width of the material web;

c) a cutting device for cutting the paper material web moving with high speed, said cutting device mounted to said positioning device, whereby said cutting device is fixed on said holding device and moves with said positioning device along said holding device over the material web, said cutting device operative to generate a cutting medium that, when applied to the material web, cuts the material web;

d) an air guide box having a substantially enclosed, box-like body including an upper surface and a bottom surface, said upper surface mounted to an underside of said holding device such that said air guide box is positioned below said positioning device and above the paper material web, said bottom surface being a flat and substantially continuous surface that spans at least a majority of a width of the paper material web, said bottom surface defining a stabilization surface that extends substantially parallel to the paper material web, said stabilization surface stabilizing and preventing speed-induced oscillations in a portion of the paper material web passing underneath said air guide box as the paper material web moves with high speed through the papermaking machine;

wherein when said cutting device is in a position to cut the material web, said air guide box is located at least partly underneath said cutting device and said cutting device executes cutting of the moving paper material web proximate to said stabilization surface of said air guide box.

7. A papermaking machine according to claim 6, wherein said air guide box has a cutout, through which said cutting medium can be led from said cutting device to the paper material web.

8. A papermaking machine according to claim 6, wherein said holding device is an upper holding device and said positioning device is an upper positioning device, said apparatus further comprising:

a cutting table;

a lower holding device positioned underneath the paper material web; and at least one of a first lower positioning device and a second lower positioning device, said cutting table being fixed to said lower holding device via said at least one of said first lower positioning device and said second lower positioning device, said cutting table being movable substantially vertically with respect to the paper material web via said first lower positioning device and/or being movable in the cross-machine direction via said second lower positioning device.

9. A papermaking machine according to claim 8, wherein said apparatus further comprises synchronizing means for the synchronization of movements of said cutting device and of said cutting table in the cross-machine direction.

10. A papermaking machine according to claim 8, wherein at least one of the upper holding device above the paper material web and the lower holding device underneath the paper material web is fixed in the cross-machine direction with both ends on vertical pillars located beside the papermaking machine.

11. A papermaking machine according to claim 6, wherein said cutting device further comprises at least one knock-off medium nozzle arranged downstream from said cutting device.

12. A papermaking machine according to claim 6 wherein a distance between the paper material web and said air guide box is smaller than that between said cutting device and the paper material web.

* * * * *